US007475453B2

(12) United States Patent
Drake et al.

(10) Patent No.: US 7,475,453 B2
(45) Date of Patent: Jan. 13, 2009

(54) BUCKLE

(75) Inventors: Raymond J. Drake, Salem, IL (US); Larry E. Maddux, Salem, IL (US)

(73) Assignee: Melas, Inc., Salem, IL (US)

( * ) Notice: Subject to any disclaimer, the term of this patent is extended or adjusted under 35 U.S.C. 154(b) by 27 days.

(21) Appl. No.: 11/116,063

(22) Filed: Apr. 27, 2005

(65) Prior Publication Data

US 2006/0242803 A1 Nov. 2, 2006

(51) Int. Cl.
*A44B 11/02* (2006.01)

(52) U.S. Cl. ..... 24/324

(58) Field of Classification Search ..... None
See application file for complete search history.

(56) References Cited

U.S. PATENT DOCUMENTS

| | | | | |
|---|---|---|---|---|
| 871,981 | A * | 11/1907 | Blum | 24/198 |
| 873,128 | A | 12/1907 | Holmes | |
| 1,712,976 | A | 5/1929 | Blair | |
| 1,753,696 | A | 4/1930 | Fenton | |
| 1,889,322 | A | 11/1932 | Reiter | |
| 1,902,557 | A | 3/1933 | Janes | |
| 1,904,055 | A | 4/1933 | King | |
| 2,292,899 | A | 8/1942 | Sanford | |
| 2,693,625 | A | 12/1954 | Van Buren, Jr. | |
| 2,800,697 | A | 7/1957 | Carpinella | |
| 2,905,991 | A | 9/1959 | Reiter | |
| 3,237,257 | A | 3/1966 | Forsberg | |
| 3,336,639 | A | 8/1967 | Rutty et al. | |
| 3,889,353 | A | 6/1975 | Provi | |
| 3,977,839 | A | 8/1976 | Palisin, Jr. | |
| 3,990,701 | A | 11/1976 | Kim | |
| 4,177,320 | A | 12/1979 | Yoshimura et al. | |
| 4,368,563 | A | 1/1983 | Lentz | |
| 4,396,658 | A | 8/1983 | Mettes et al. | |
| 4,628,004 | A | 12/1986 | Nickola et al. | |
| 4,642,853 | A | 2/1987 | Plesniarski | |
| 4,944,530 | A | 7/1990 | Spurrier | |
| 5,091,260 | A | 2/1992 | Wong | |
| 5,138,749 | A | 8/1992 | McCune et al. | |
| 5,242,714 | A | 9/1993 | Steele et al. | |
| 5,259,096 | A | 11/1993 | Grant | |
| 5,281,435 | A | 1/1994 | Buecher | |
| 5,345,656 | A | 9/1994 | Merritt | |
| 5,385,655 | A | 1/1995 | Brent et al. | |
| 5,603,818 | A | 2/1997 | Brent et al. | |
| 5,779,729 | A | 7/1998 | Severini | |
| 5,974,637 | A | 11/1999 | Tracy et al. | |
| 6,021,693 | A | 2/2000 | Feng-Sing | |
| 6,290,259 | B1 | 9/2001 | Drobot et al. | |
| 6,481,066 | B1 * | 11/2002 | Ide et al. | 24/324 |
| 6,497,012 | B2 | 12/2002 | Ide et al. | |
| 6,532,632 | B1 | 3/2003 | Halstead | |

* cited by examiner

*Primary Examiner*—Jack W. Lavinder
(74) *Attorney, Agent, or Firm*—Brinks Hofer Gilson & Lione

(57) ABSTRACT

A buckle includes a metal component having only a first opening and a second opening. The first opening is defined by a first internal perimeter including a first serrated edge. The second opening is defined by a second internal perimeter including a second serrated edge. The buckle also includes a rust resistant component substantially encasing the metal component. However, the rust resistant component does not encase the first serrated edge or the second serrated edge.

11 Claims, 7 Drawing Sheets

38
22
24
40
20
52
30
50
48
46
34
26

42
52
40
44
50
46
38

24'
30
L
L
22''
26'
34'

30
34'
31
22'
24
28
36
32
26'
35
34'

30
34'
31
22
24
48
36
28
26
35
34
32

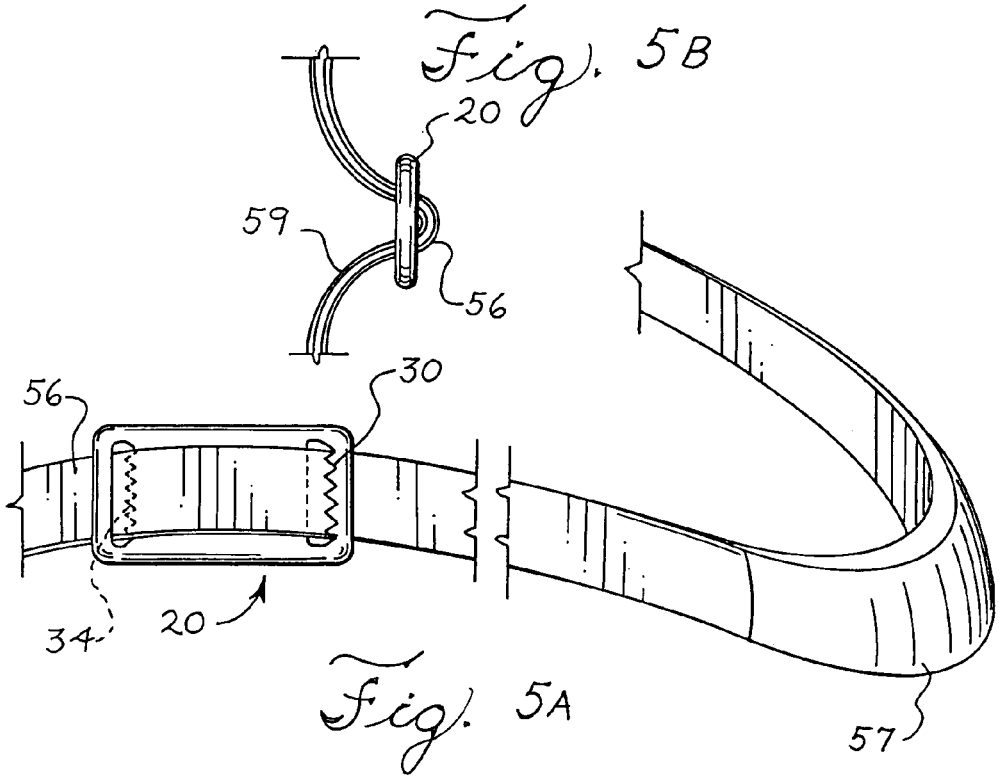
Fig. 5B
Fig. 5A
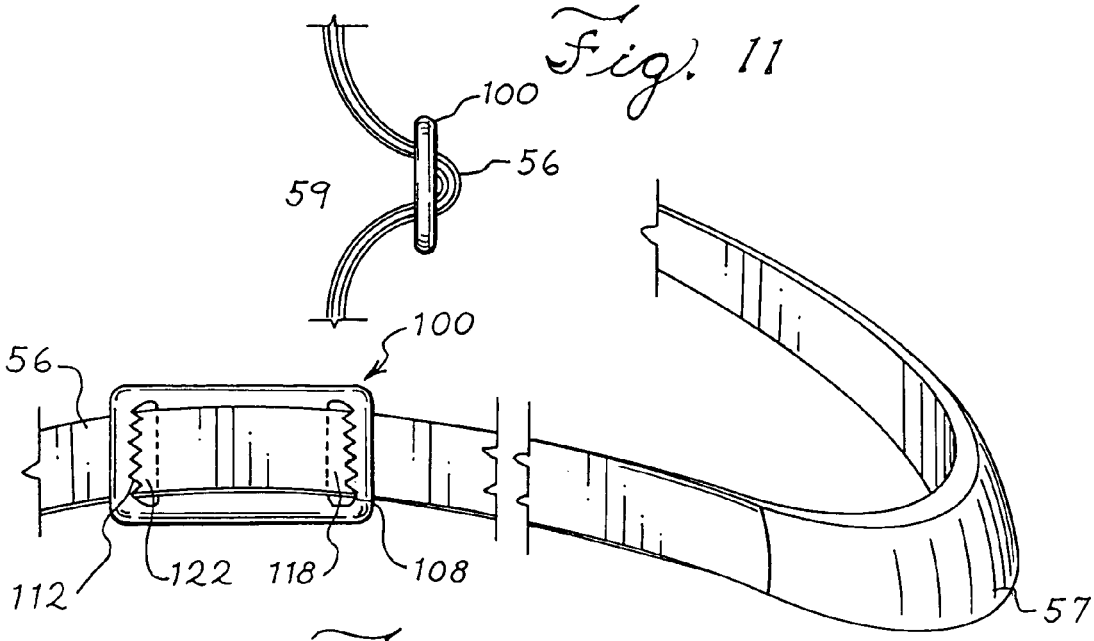
Fig. 11
Fig. 12

BUCKLE

TECHNICAL FIELD

This invention relates generally to buckles. More particularly, this invention relates to a buckle of the type suitable for use with football helmet chin straps.

BACKGROUND OF THE INVENTION

Buckles of metal construction are known. Conventional metal buckles have shortcomings in that they are readily bent and are susceptible to corrosion. Consequently, there is a need for buckles that have improved corrosion resistance.

SUMMARY OF THE INVENTION

According to an aspect of the present invention, a buckle may include a metal component having only a first opening and a second opening. The first opening is defined by a first internal perimeter including a first serrated edge. The second opening is defined by a second internal perimeter including a second serrated edge. The buckle also includes a rust resistant component substantially encasing the metal component. However, the rust resistant component does not encase the first serrated edge or the second serrated edge.

According to another aspect of the invention, a buckle may include a metal component having only a single opening. The opening is defined by an internal perimeter including a serrated edge. The buckle also includes a rust resistant component substantially encasing the metal component. However, the rust resistant component does not encase the serrated edge.

According to a further aspect of the invention, a strap system may include one of the buckles described above and a strap member frictionally engaging with at least a serrated edge.

According to yet another aspect of the invention, a method of making a buckle includes providing one of the metal components as described above, placing the metal component in an injection mold configured to provide a molten material to form the rust resistant component, and introducing the molten material to substantially encase the metal component. However, the molten material does not encase the first serrated edge or the second serrated edge.

BRIEF DESCRIPTION OF THE DRAWINGS

FIG. 5A depicts a top plan view of the buckle of FIG. 1 engaging an embodiment of a chin strap.

FIG. 5B depicts a side view of the buckle of FIG. 5A having a looped chin strap.

FIG. 11 depicts a top plan view of the buckle of FIG. 6 with an embodiment of a snap socket attached thereto and engaging an embodiment of a chin strap.

FIG. 12 depicts a side view of the buckle of FIG. 11 having a looped chin strap.

DETAILED DESCRIPTION

Figures 1, 2A, 2B, 2C, 3:
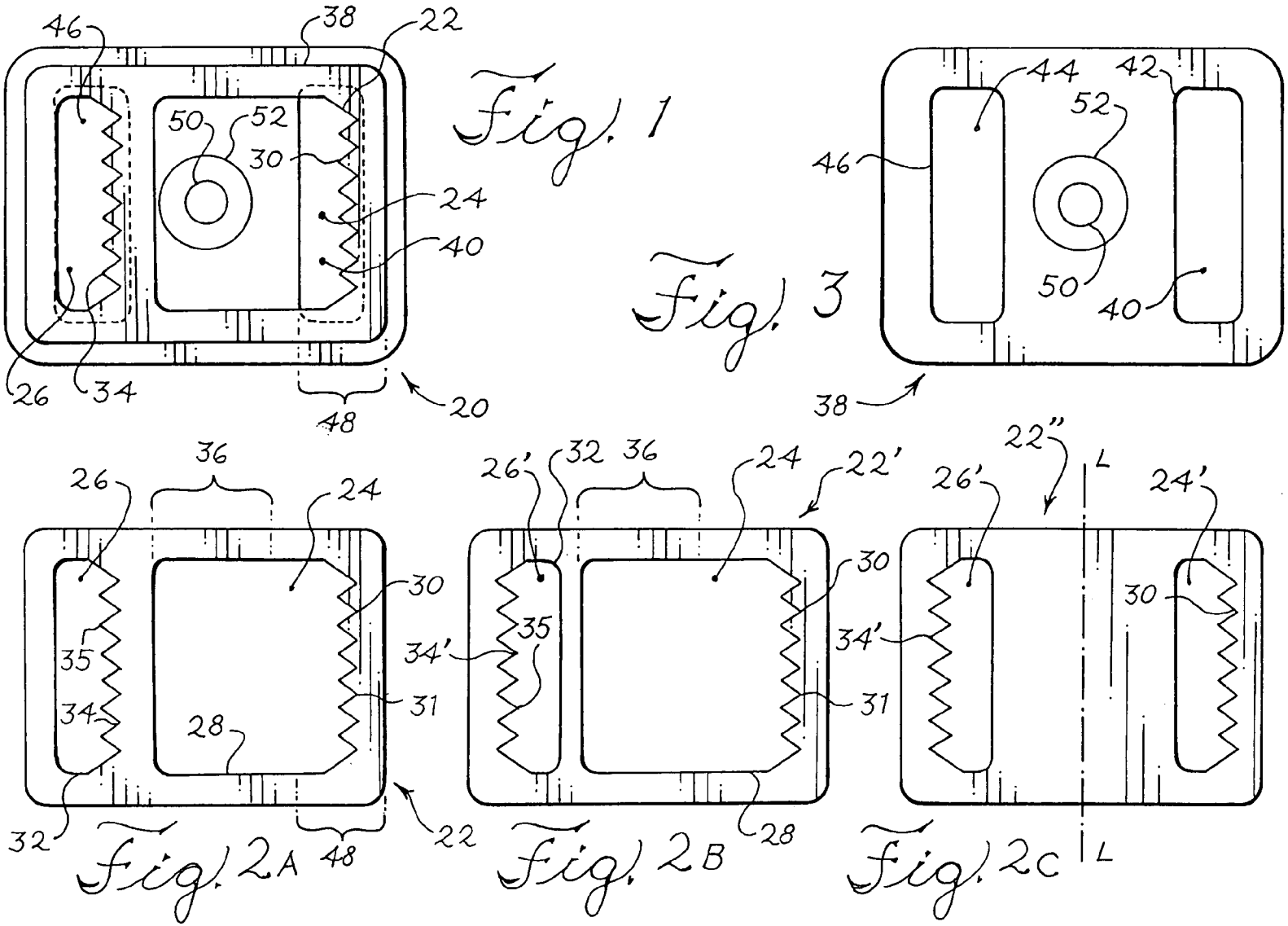
FIG. 1 depicts a top plan view of an embodiment of a buckle in accordance with the present invention.
FIG. 2A depicts a top plan view of an embodiment of a metal component of the buckle of FIG. 1.
FIG. 2B depicts a top plan view of another embodiment of the metal component of the buckle of FIG. 1.
FIG. 2C depicts a top plan view of yet another embodiment of the metal component of the buckle of FIG. 1.
FIG. 3 depicts a top plan view of an embodiment of a rust resistant component of the buckle of FIG. 1 with the metal component of FIG. 2 removed.

A better understanding of the present invention will now be had upon reference to the following detailed description, when read in conjunction with the accompanying drawings, wherein like reference characters refer to like parts throughout the several views of the present invention.

The buckle 20 according to an embodiment of the present invention includes a metal component 22 having only two openings 24 and 26, as shown in FIG. 2A. The opening 24 is defined by an internal perimeter 28 having a serrated edge 30 on a side 31. The opening 26 is defined by an internal perimeter 32 having a serrated edge 34 on a side 35. In one embodiment, the serrated edge 30 and the serrated edge 34 face the same direction, as shown in FIG. 2A. In another embodiment, the serrated edge 30 and the serrated edge 34' of the metal component 22' face each other, as shown in FIG. 2B. In each embodiment, the opening 24 has a larger surface area than the openings 26 or 26'. The opening 24 extends over a central portion 36 of the metal component 22. Preferably, the openings 24 and 26 or 26' are rectangular-like in shape. In yet another embodiment, the openings 24' and 26' of the metal component 22" have the same size, as shown in FIG. 2C. Therefore, the metal component 22" is symmetrical with respect to line L-L, which bisects the metal component 22".

The metal components 22, 22' and 22" are preferably of one piece, half-hard stainless steel construction.

The buckle 20 also includes a rust resistant component 38 substantially encasing the metal component 22, as shown in FIG. 1. However, the rust resistant component 38 does not encase the serrated edge 30 nor the serrated edges 34 or 34'. The rust resistant component 38 includes an opening 40 defined by an internal perimeter 42 and an opening 44 defined by an internal perimeter 46, as shown in FIG. 3. The opening 40 is configured to align with a portion 48 of the opening 24, as shown in FIG. 1. The opening 44 is configured to substantially align with the opening 26. Preferably, the openings 40 and 46 are rectangular-like shape.

The rust resistant component 38 may also include an aperture 50 between the openings 40 and 44, as shown in FIG. 3. The aperture 50 is positioned over the opening 24, as shown in FIG. 1. Preferably, the aperture 50 is circular-like in shape. The rust resistant component 38 is preferably provided by a plastic or polymer such as a polycarbonate or a glass-filled nylon.

Figure 4A:
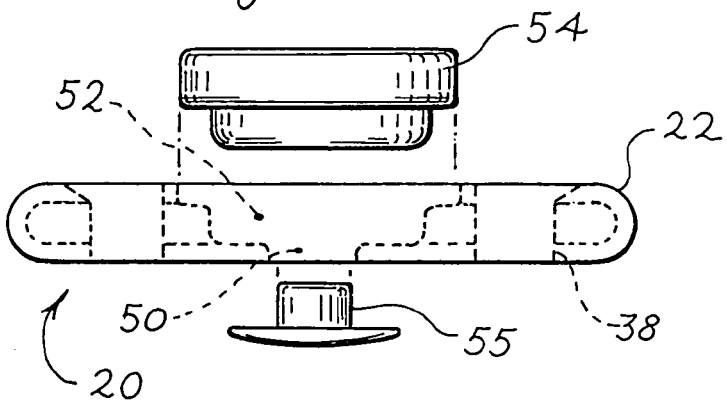
FIG. 4A depicts a front view of the buckle of FIG. 1 having an embodiment of an aperture and a snap socket to receive a rivet and a snap member.
Figure 4B:
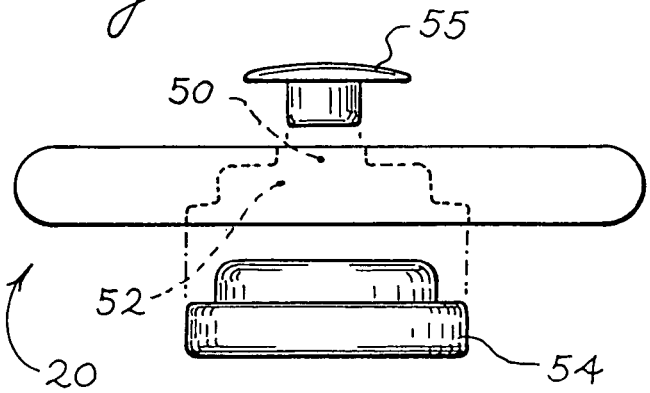
FIG. 4B depicts another front view of the buckle of FIG. 1 having another embodiment of the aperture and the snap socket.
Figure 4C:
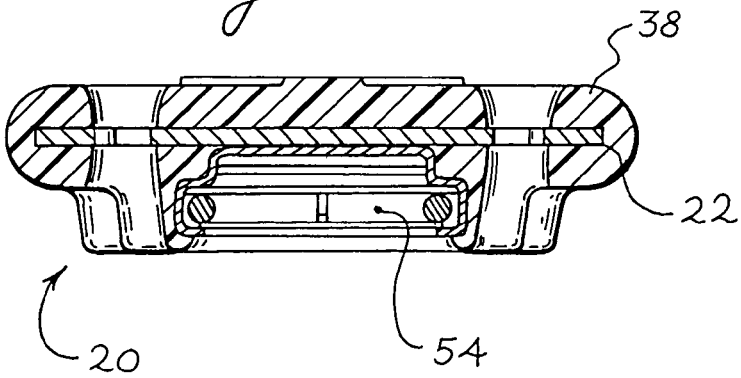
FIG. 4C depicts another front view of the buckle of FIG. 1 having yet another embodiment of the snap socket.

As shown in FIGS. 3 and 4A, the buckle 20 may further include a snap socket 52 defined by the rust resistant component 38 and is positioned over the aperture 50 for operatively receiving a snap member 54. The snap member 54 is preferably made of stainless steel. The snap socket 52 is configured for receiving and mating in a snap-fit relationship with a conventional snap member 54 by methods generally known in the art. For example, the snap member 54, such as a snap-stud fastener, may be riveted onto the snap socket 52 by passage of a shaft of a rivet 55 through aperture 50, as shown in FIG. 4A. It is noted that the position of the aperture 50 and the snap socket 52 may be reversed, as shown in FIG. 4B.

Moreover, the buckle 20 may include a strap member 56 to be used with a chin cup 57 of a football helmet, as shown in FIG. 5A. The openings 24 and 26 are configured to allow the strap member 56 to pass through. The serrated edges 30 and 34 are designed to frictionally engage with the strap member 56 to prevent slippage. It is noted that strap member 56 may loop around the buckle 20 for better adjustment or tighter contact, depending on the particular use. The buckle 20 may also include multiple strap members 59 formed from the single strap member 56 looped about itself, as depicted in FIG. 5B, also for better adjustment or tighter contact, depending on the particular use.

Note that a similar buckle can be formed using metal component 22' of FIG. 2B and using the same components and processes as described previously with respect to the buckle 20 of FIGS. 1, 2A and 3-5.

Figure 20:
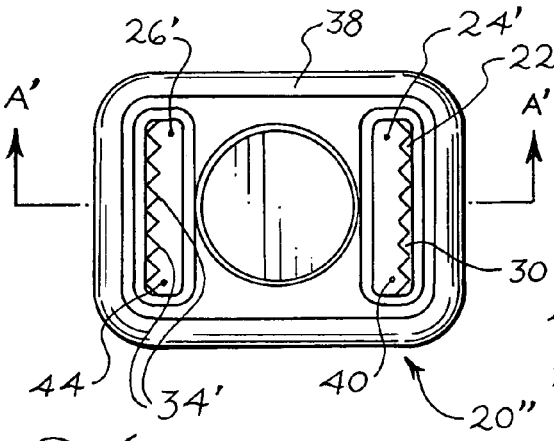
FIG. 20 depicts the top view of the buckle of FIG. 1 having the metal component of FIG. 4C.
Figure 21:
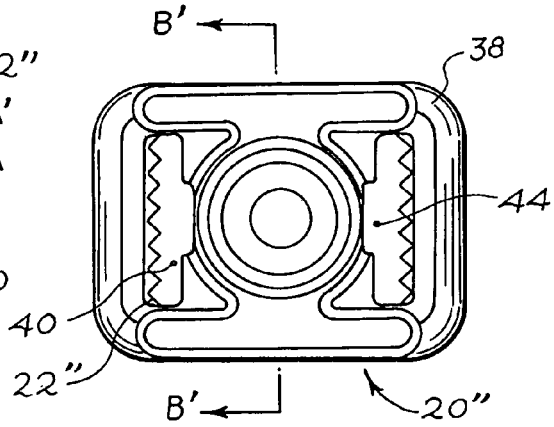
FIG. 21 depicts the bottom view of the buckle of FIG. 20.

In another embodiment, the buckle 20" having the metal component 22" is shown in FIGS. 20 and 21. As noted above and as shown in FIG. 2C, the openings 24' and 26' of the metal component 22" have the same size. The buckle 20" includes a rust resistant component 38 substantially encasing the metal component 22"; however, the rust resistant component 38 does not encase the serrated edge 30 nor the serrated edge 34', as shown in FIGS. 20 and 21. The opening 40 of the rust resistant component 38 is configured to substantially align with the opening 24', while the opening 44 is configured to substantially align with the opening 26'.

Figure 22:
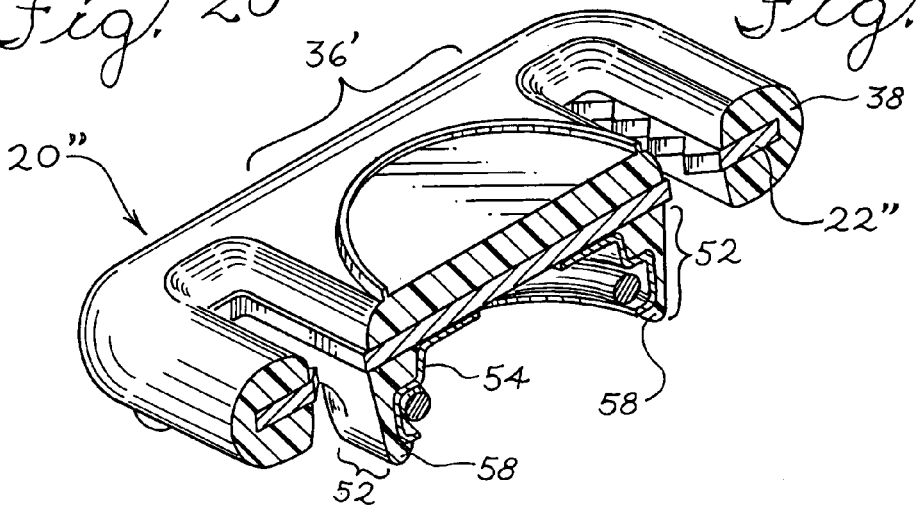
FIG. 22 depicts the cross section of FIG. 21 along line A'-A'.
Figure 23:
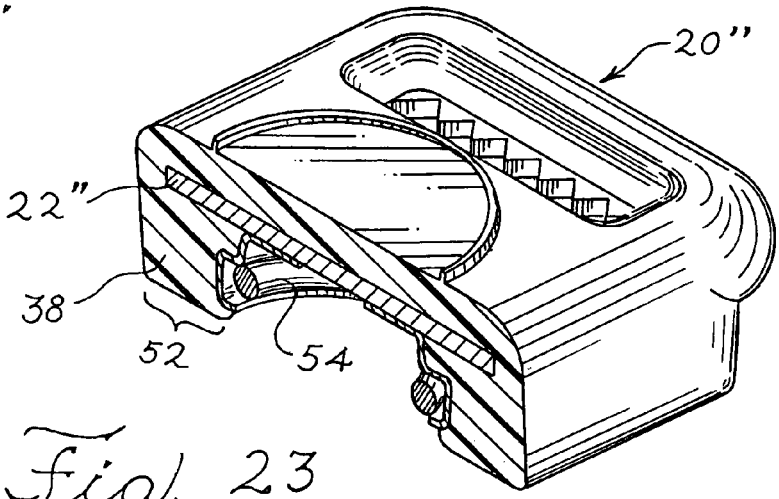
FIG. 23 depicts the cross section of FIG. 21 along line B'-B'.

The buckle 20" includes the snap socket 52 defined by the rust resistant component 38 for operatively receiving the snap member 54, as shown in FIGS. 22 and 23. The snap member 54 is preferably made of stainless steel. The snap member 54 is configured to make direct contact with the central portion 36' of the metal component 22". Preferably, the buckle 20" does not include an aperture 50 or a rivet 55 for securing the snap member 54 to the buckle 20". The buckle 20" may include a strap member 56 to be used within a chin cup 57 of a football helmet as described above.

Figure 8:
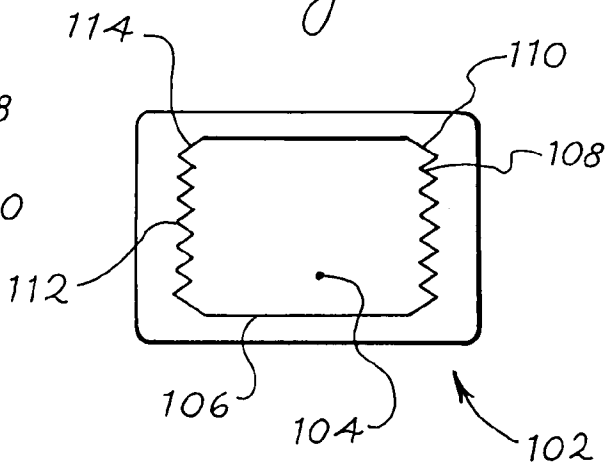
FIG. 8 depicts a top plan view of an embodiment of a metal component of the buckle of FIG. 6.
Figure 9:
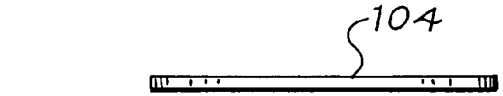
FIG. 9 depicts a front view of the metal component of FIG. 8.

The buckle 100 according to another embodiment of the present invention is shown in FIGS. 6-16 and includes a metal component 102 having only a single opening 104, as shown in FIGS. 8 and 9. The opening 104 is defined by an internal perimeter 106 having a serrated edge 108 on a side 110 and a serrated edge 112 on an opposite side 114, as shown in FIG. 8. Preferably, the serrated edge 108 and the serrated edge 112 face each other. Preferably, the opening 104 is rectangular-like in shape.

Figures 7A, 7B, 13, 14, 15, 16:
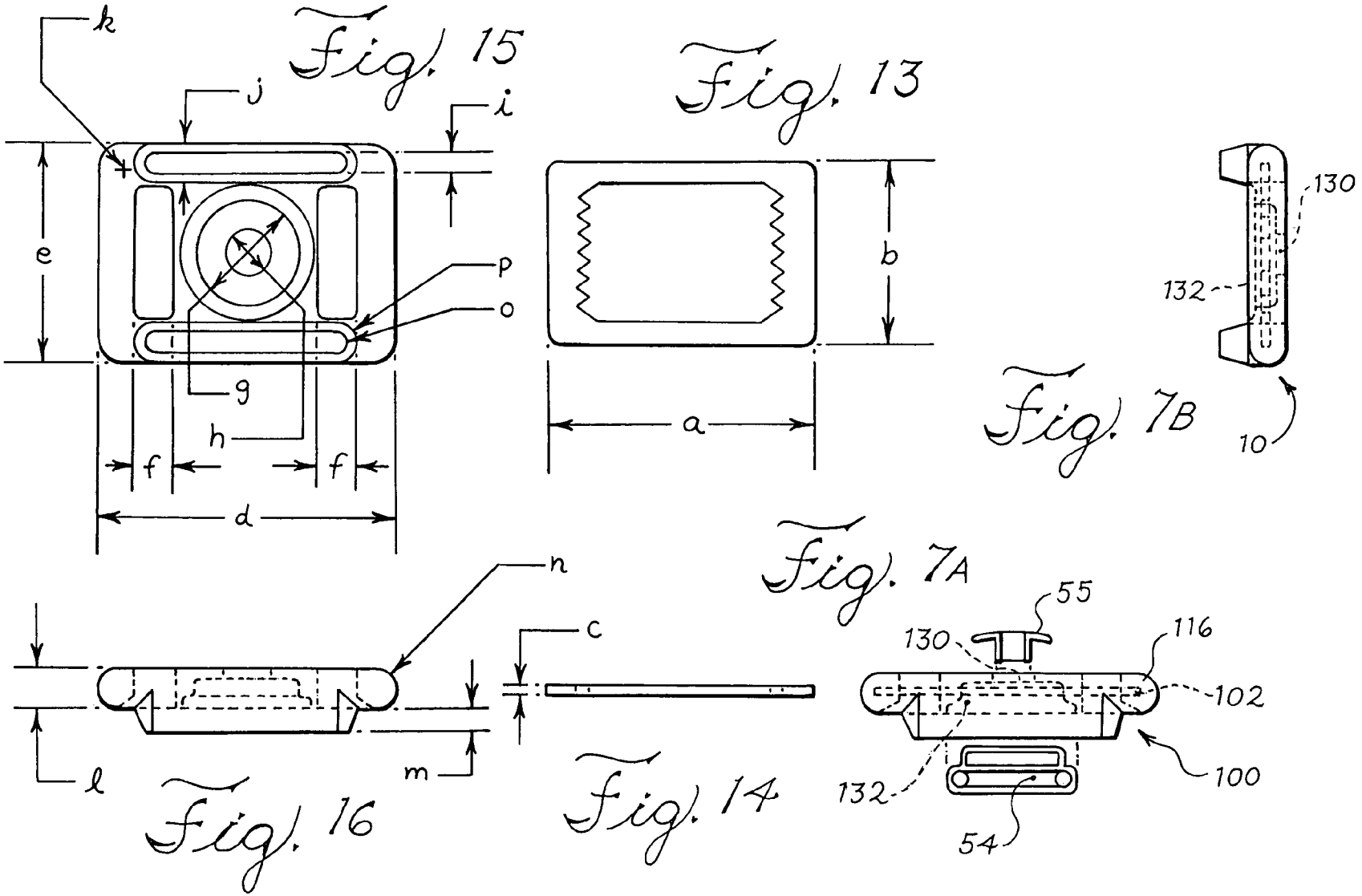
FIG. 7A depicts a front view of the buckle of FIG. 6 having an embodiment of an aperture and a snap socket to receive a rivet and a snap member.
FIG. 7B depicts a side view of the buckle of FIG. 7B.
FIG. 13 depicts the preferred dimensions of the metal component of FIG. 8.
FIG. 14 depicts the preferred dimensions of the metal component of FIG. 9.
FIG. 15 depicts the preferred dimensions of the rust resistant component of FIG. 10.
FIG. 16 depicts the preferred dimensions of the rust resistant component of FIG. 11.

The metal component 102 is preferably of one piece, half-hard stainless steel construction. FIGS. 13, 14 and Table 1 below describe the preferred dimensions of the metal component 102.

TABLE 1

| Reference letter | Dimensions (in inches unless specified) |
|---|---|
| a | 1.110 |
| b | 0.820 |
| c | 0.035 |

Figure 6:
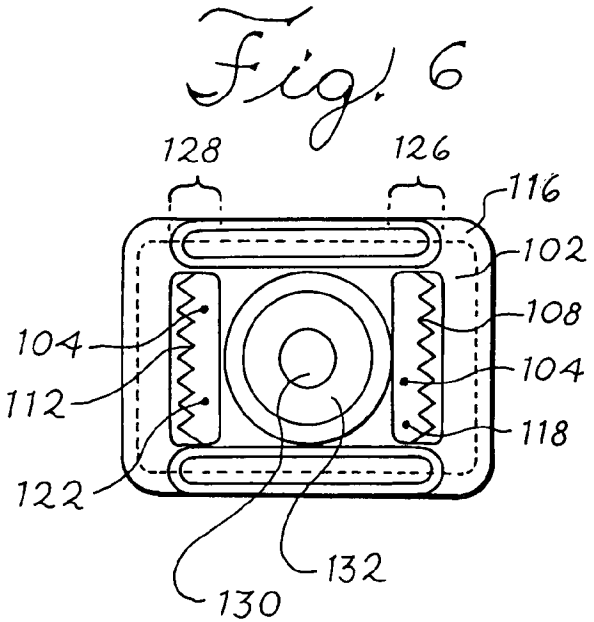
FIG. 6 depicts a bottom plan view of another embodiment of a buckle in accordance with the present invention.
Figure 10:
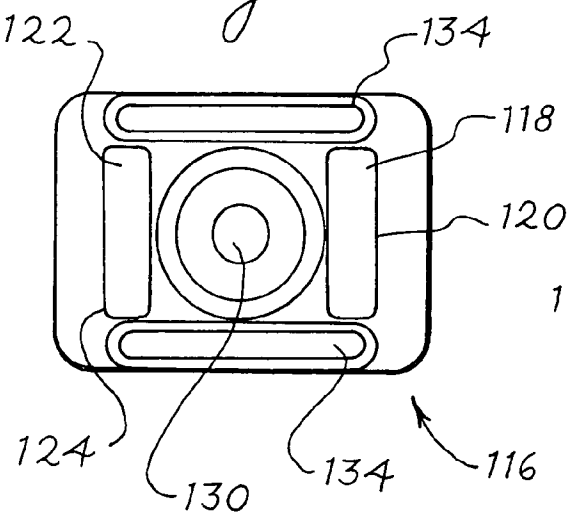
FIG. 10 depicts a bottom plan view of an embodiment of a rust resistant component of the buckle of FIG. 6 with the metal component of FIG. 8 removed.

The buckle 100 also includes a rust resistant component 116 substantially encasing the metal component 102, as shown in FIGS. 6 and 7A. However, the rust resistant component 116 does not encase the serrated edge 108 or the serrated edge 112. The rust resistant component 116 includes an opening 118 defined by an internal perimeter 120 and an opening 122 defined by an internal perimeter 124, as shown in FIGS. 10 and 11. The opening 118 is configured to align with a portion 126 of the opening 104 of the metal component 102, as shown in FIG. 6. The opening 122 is configured to substantially align with another portion 128 of the opening 104. Preferably, the openings 118 and 122 are rectangular-like in shape. Moreover, the rust resistant component 116 includes an aperture 130 between the openings 118 and 122. The aperture 130 is positioned over the opening 104, as shown in FIG. 6. Preferably, the aperture 130 is circular-like in shape.

The rust resistant component 116 is preferably provided by a plastic or polymer such as a polycarbonate or a glass-filled nylon. FIGS. 15, 16 and Table 2 below describe the preferred dimensions of the rust resistant component 116.

TABLE 2

| Reference letter | Dimensions (in inches unless specified) |
|---|---|
| D | 1.210 |
| E | 0.925 |
| F | 0.145 |
| G | 0.440 (diameter) |
| H | 0.190 (diameter) |
| I | 0.145 |
| J | 0.160 |
| K | 0.150 (radius) |
| L | 0.187 |
| M | 0.090 |
| N | 0.078 (radius) |
| O | 0.072 (radius) |
| P | 0.080 (radius) |

As shown in FIGS. 6, 7A and 7B, the buckle 100 may further include a snap socket 132 defined by the rust resistant component 116 and is positioned over the aperture 130 for operatively receiving a snap member 54, for example, by passage of a shaft of a rivet 55 through aperture 130, in the same way described previously with respect to the rivet 55 and aperture 50 of the buckle of FIGS. 1-5. As shown in FIG.

10, the rust resistant component 116 also includes two elongated members 134 designed to rest on a surface of a helmet (not shown) to prevent slippage. When the received snap member 54 mates with a protruded snap member 142 of the helmet during use, the elongated members 134, while contacting the surface of the helmet, prevent the buckle 100 from sliding or pivoting out of position due to unintended contact. This results in less bending of the buckle 100 when compared to known metal buckles. Therefore, in the embodiment where the buckle 100 contains elongated members 134, the snap socket 132 is designed to position therein the snap member 54 on the same side of the elongated members 134, as depicted in FIGS. 6, 7A, 7B and 10. In the embodiment where the buckle 20 does not contain any elongated members 134, the snap socket 52 may be located at either side in a manner similar to that depicted in the buckle of FIGS. 4A and 4B.

Moreover, the buckle 100 may include a strap member 56 to be used with a chin cup 57 of a football helmet, as shown in FIG. 11. The openings 118 and 122 are configured to allow the strap member 56 to pass through, also in the same way described above. It is noted that strap member 56 may loop around the buckle 100 and the buckle 100 may include multiple strap members 59 formed from the single strap member 56, as depicted in FIG. 12, the same way described above with respect to FIG. 5B.

A method of making the buckles 20 and 100 can be conducted by what is known as an insert molding. In the case of the buckle 20, the first stage of the process includes providing the metal component 22. The second stage of the process includes placing the metal component 22 in an injection mold configured to provide a molten material to form the rust resistant component 38. It is noted that the injection mold is configured to hold the metal component 22 in place, for example by a platform, while covering the serrated edges 30 and 34. The third stage of the process includes introducing the molten material to substantially flow around and encase the metal component 22. The rust resistant component 38 is formed in the shape shown in FIG. 3, where the rust resistant component 38 does not encase the serrated edge 30 or the serrated edge 34. Subsequently, the snap member 54 is inserted into the snap socket 52 and is secured to the buckle 20 by the rivet 55. A method of making the buckle 20 with metal component 22' of FIG. 2B or the buckle 100 can be conducted in a similar manner as described above.

Another method of making buckles similar to those shown in FIG. 1-16 may be conducted. The buckles differ in that they lack a rivet 55. In the case of the buckle similar to buckle 100, the first stage of the process includes providing the metal component 102. The second stage of the process includes placing the metal component 102 in the injection mold configured to provide a molten material to form a rust resistant component 116'. It is noted that the injection mold is configured to hold the metal component 102 in place, for example by a platform, while covering the serrated edges 108 and 112. The third stage of the process includes placing the snap member 54 in the injection mold positioned over the opening 104 of the metal component 102. It is noted that the injection mold is configured to hold the snap member 54 in place, for example by a post, while covering the inner portions of the snap member 54.

Figure 17:
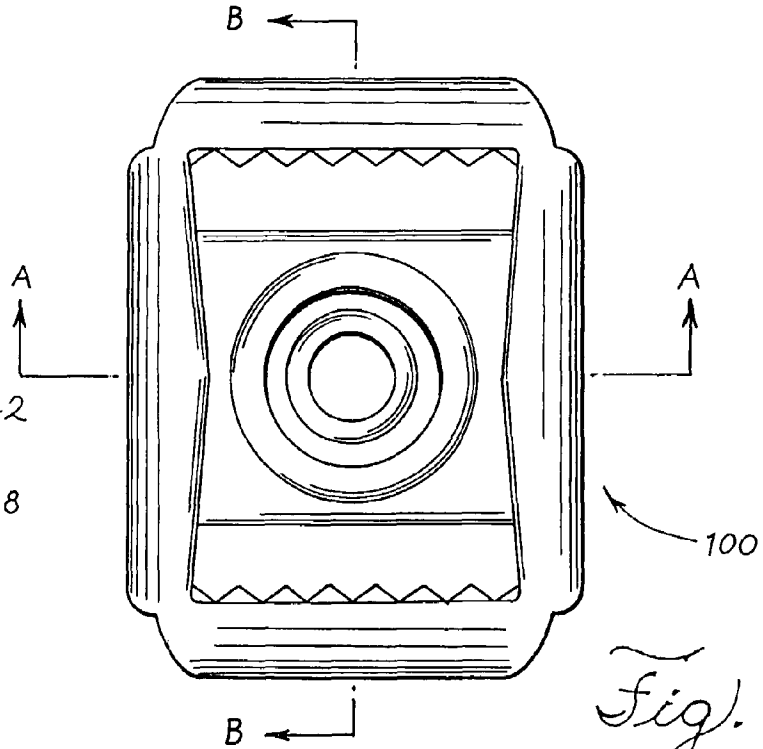
FIG. 17 depicts another embodiment of a buckle manufactured by a different method.
Figure 18:
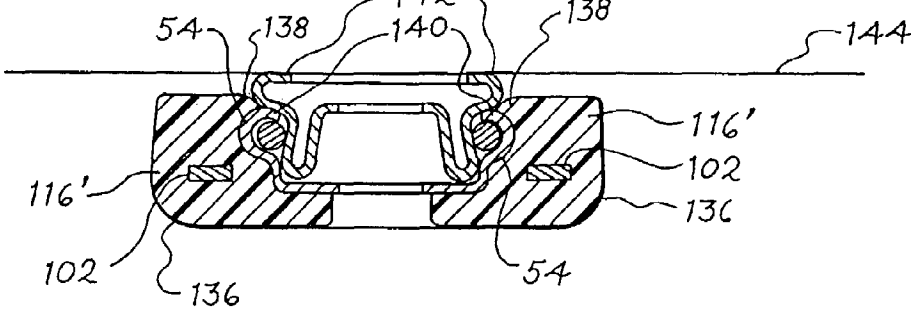
FIG. 18 depicts the cross section of FIG. 17 along line A-A.
Figure 19:
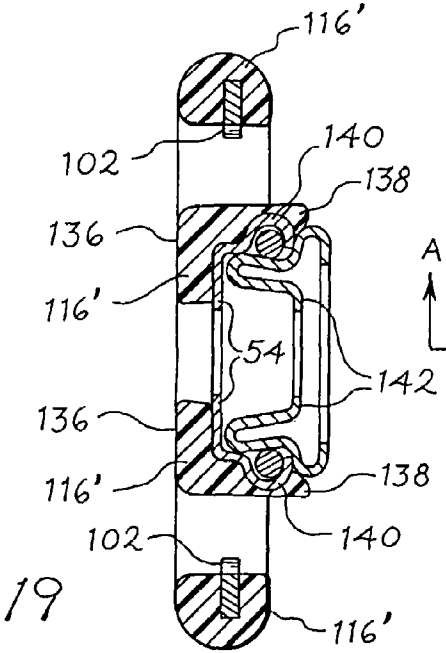
FIG. 19 depicts the cross section of FIG. 17 along line B-B.

The fourth stage of the process includes introducing the molten material to substantially flow around and encase the metal component 102 and the snap member 54. The rust resistant component 116' is formed in the shape shown in FIGS. 17-19, where the rust resistant component 116' does not encase the serrated edge 108, the serrated edge 112, or the inner portions of the snap member 54, as depicted in FIG. 17. The fourth stage increases the height of the side walls 136 of the rust resistant component 116' when compared with the side walls of the rust resistant component 116 of FIGS. 6-16. This enables the snap member 54 to be positioned deeper into the rust resistant component 116' as compared to the methods described previously with respect to FIGS. 6-16. The rust resistant component 116' defines protruding edges 138 that overlie the upper rim 140 of the snap member 54 so as to securely hold the snap member 54 into place. The edges 138 are tapered where the rust resistant component 116' is configured to come into contact with the protruding snap member 142 of the helmet 144 for a tighter snapping fit between the protruding snap member 142 and the snap member 54, as depicted in FIG. 18. Thus, the rivet 55 is not needed in this method.

It is noted that a method of making the buckle 20" can be conducted in a similar manner to that described above, except that the third stage of the process includes having a pair of clamps, for example, hold the snap member 54 against the central portion 36' of the metal component 22" within the injection mold. Next, as the molten material is introduced, the clamps are removed and the molten material encompasses the metal component 22" and the snap member 54. As shown in FIG. 22, a lip 58 of the snap socket 52 is formed underneath the snap member 54 and acts to clamps the snap member 54 in place. A method of making alternative embodiments of the buckle of FIGS. 1-5 can be conducted in a similar manner to that described above.

While the preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

What is claimed is:

1. A buckle comprising:

a metal component having only a single opening defined by an internal perimeter comprising a serrated edge; and a rust resistant component substantially encasing said metal component, said rust resistant component not encasing said serrated edge, wherein besides said rust resistant component, there are no elements contacting both one side of said metal component and an opposing side of said metal component and which cover a portion of said single opening.

2. The buckle of claim 1, wherein said rust resistant component further comprising an aperture positioned over said single opening.

3. The buckle of claim 2, further comprising a snap socket defined by the rust resistant component and positioned over said opening for operatively receiving a snap member.

4. The buckle of claim 3, wherein said snap socket is defined solely by the rust resistant component.

5. The buckle of claim 3, wherein said snap member is riveted onto said snap socket through an aperture.

6. The buckle of claim 1, wherein said metal component further comprises a second serrated edge.

7. The buckle of claim 6, wherein said rust resistant component does not encase said second serrated edge.

8. The buckle of claim 6, wherein said serrated edge and said second serrated edge face each other.

9. The buckle of claim 1, further comprises two elongated members configured to balance on a surface of a helmet.

10. A strap system comprising:

a buckle comprising:

a metal component having only a single opening defined by an internal perimeter comprising a serrated edge; and a rust resistant component substantially encasing said metal component, said rust resistant component not encasing said serrated edge, wherein besides said rust resistant component, there are no elements contacting both one side of said metal component and an opposing side of said metal component and which cover a portion of said single opening; and a strap member frictionally engaging with said serrated edge.

11. The buckle of claim 10, wherein said strap member comprises a chin cup.

* * * * *